US009627825B2

(12) United States Patent
Leng et al.

(10) Patent No.: US 9,627,825 B2
(45) Date of Patent: Apr. 18, 2017

(54) LARGE CURRENT FEMALE CONNECTOR FOR HIGH-SPEED TRANSMISSION

(71) Applicant: BizConn International Corp., Guangdong Province (CN)

(72) Inventors: Qiang Leng, Guangdong (CN); Hong-Guang Kuang, Guangdong (CN); Jia-Mao Zheng, Guangdong (CN)

(73) Assignee: BizConn International Corp., Guangdong Province (CN)

( * ) Notice: Subject to any disclaimer, the term of this patent is extended or adjusted under 35 U.S.C. 154(b) by 125 days.

(21) Appl. No.: 14/735,155

(22) Filed: Jun. 10, 2015

(65) Prior Publication Data

US 2016/0064872 A1 Mar. 3, 2016

(30) Foreign Application Priority Data

Sep. 2, 2014 (CN) ..... 2014 2 0499922 U

(51) Int. Cl.

| | |
|---|---|
| ***H01R 13/6585*** | (2011.01) |
| ***H01R 13/6597*** | (2011.01) |
| ***H01R 24/60*** | (2011.01) |
| ***H01R 13/6581*** | (2011.01) |
| *H01R 107/00* | (2006.01) |

(52) U.S. Cl.

CPC ..... *H01R 24/60* (2013.01); *H01R 13/6581* (2013.01); *H01R 2107/00* (2013.01)

(58) Field of Classification Search

CPC H01R 13/6585; H01R 24/60; H01R 13/6597; H01R 2107/00

See application file for complete search history.

(56) References Cited

U.S. PATENT DOCUMENTS

| | | | | |
|---|---|---|---|---|
| 7,488,188 | B2 * | 2/2009 | Moriyama | H01R 13/26 439/108 |
| 7,604,510 | B2 * | 10/2009 | Akama | H01R 23/688 439/637 |
| 7,976,317 | B2 * | 7/2011 | Patel | H01R 12/7088 439/699.1 |
| 8,007,322 | B2 * | 8/2011 | Okuyama | H01R 13/6585 439/607.08 |
| 8,047,875 | B2 * | 11/2011 | Yamakami | H01R 13/6315 439/108 |
| 8,398,433 | B1 * | 3/2013 | Yang | H01R 13/6587 439/108 |

(Continued)

FOREIGN PATENT DOCUMENTS

CN 102709723 A 10/2012

*Primary Examiner* — Briggitte R Hammond

(74) *Attorney, Agent, or Firm* — CKC & Partners Co., Ltd.

(57) ABSTRACT

Provided is a large current female connector for high-speed transmission, comprising a case, an insulating body, and an upper terminal group and a lower terminal group disposed in the insulating body. The insulating body is disposed in the case. A power terminal in the upper terminal group and a corresponding power terminal in the lower terminal group are connected to form a big power terminal. An insulating body trench for accommodating the big power terminal is disposed on the insulating body. The present invention has advantages in that the fabrication process is simple and cost effective, and a large current transport is possible.

16 Claims, 6 Drawing Sheets

(56) References Cited

U.S. PATENT DOCUMENTS

| | | | | |
|---|---|---|---|---|
| 8,444,438 | B2 * | 5/2013 | Gao | H01R 12/73 439/607.35 |
| 8,944,863 | B1 * | 2/2015 | Yang | H01R 13/6585 439/607.08 |
| 9,065,214 | B2 * | 6/2015 | Nakashima | H01R 13/6585 |
| 2006/0003620 | A1 * | 1/2006 | Daily | H01R 13/113 439/295 |
| 2007/0275586 | A1 * | 11/2007 | Ngo | H01R 12/7088 439/290 |
| 2012/0164892 | A1 * | 6/2012 | Ke | H01R 27/02 439/676 |
| 2013/0171856 | A1 * | 7/2013 | Tai | H01R 13/02 439/345 |
| 2013/0244504 | A1 * | 9/2013 | Ogura | H01R 13/11 439/759 |

* cited by examiner

LARGE CURRENT FEMALE CONNECTOR FOR HIGH-SPEED TRANSMISSION

RELATED APPLICATIONS

This application claims priority to Chinese Patent Application Serial Number 201420499922.7, filed on Sep. 2, 2014. The entirety of the aforementioned application is hereby incorporated by reference and made a part of this specification.

BACKGROUND

Field of Invention

The present invention is related to a female connector, and more particularly, to a large current female connector for high-speed transmission.

Description of Related Art

With the popularity of the large-screen mobile terminal, the accompanying high power consumption has become an urgent issue that people have to address. To solve this problem, high-capacity batteries are developed, but the charging current for a high-capacity battery is limited by the USB connector. The dimension of a standard power terminal cannot be changed, and thus the standard power terminal can only carry limited current. The higher the electric capacity of a battery is, the longer the charging time is required. China Patent reference CN102709723 A discloses a USB connector capable of carrying higher current, the USB connector includes a power terminal, in which the USB connector further includes an assistant power terminal. The power terminal and the assistant power terminal are configured to be simultaneously in electrical contact with a power terminal of a mating USB connector.

In the aforementioned USB connector, an assistant power terminal is added. Consequently, in the process of fabricating the USB connector capable of carrying higher current, the original mold of terminal group has to be changed, and the amount of material for making the power terminal increases. The fabrication process becomes more complicated, and the cost is accordingly enhanced. In sum, the addition of a power terminal increases the consumption of manpower and material resources.

SUMMARY

In regard to the aforementioned issues, it is an object of the present invention to provide a large current female connector for high-speed transmission which can be fabricated without changing the mold, is capable of carrying large current, and cost effective.

The technical solution of the present invention is to design a large current female connector for high-speed transmission, the female connector including a case, an insulating body, and an upper terminal group and a lower terminal group disposed in the insulating body. The insulating body is disposed in the case. A power terminal in the upper terminal group and a corresponding power terminal in the lower terminal group are connected to form a big power terminal, wherein an insulating body trench for accommodating the big power terminal is disposed on the insulating body.

As a further improvement to the aforementioned technical solution, the insulating body includes an upper insulating body, a middle insulating body and a lower insulating body. The upper terminal group is disposed on the upper insulating body. The lower terminal group is disposed on the lower insulating body. The upper insulating body and the lower insulating body are engaged with the middle insulating body to form an integrated device.

As a further improvement to the aforementioned technical solution, a shielding sheet is further included, wherein a shielding sheet trench for accommodating the big power terminal is disposed on the shielding sheet. The shielding sheet is disposed in the middle insulating body.

As a further improvement to the aforementioned technical solution, the insulating body includes an upper insulating body and a lower insulating body, wherein the upper terminal group is disposed on the upper insulating body, and the lower terminal group is disposed on the lower insulating body.

As a further improvement to the aforementioned technical solution, a shielding sheet is further included. A shielding sheet trench for accommodating the big power terminal is disposed on the shielding sheet, wherein the shielding sheet is disposed between the upper insulating body and the lower insulating body. The upper insulating body and the lower insulating body are engaged to form an integrated device.

As a further improvement to the aforementioned technical solution, a shielding sheet is further included, wherein a shielding sheet trench for accommodating the big power terminal is disposed on the shielding sheet. The insulating body is integrally formed, and the shielding sheet is inserted into the insulating body.

As a further improvement to the aforementioned technical solution, the shielding sheet further includes an upper spring plate and a lower spring plate, wherein the upper spring plate is physically and electrically connected to the upper ground terminal located at an upper layer of the insulating body, and the lower spring plate is physically and electrically connected to the lower ground terminal located at a lower layer of the insulating body.

As a further improvement to the aforementioned technical solution, the shielding sheet includes an upper spring plate and a lower spring plate, wherein the upper spring plate is physically and electrically connected to the upper ground terminal located at the upper insulating body, and the lower spring plate is physically and electrically connected to the lower ground terminal located at the lower insulating body.

As a further improvement to the aforementioned technical solution, a first shielding engaging case and a second shielding engaging case are further included. A first hook is disposed on the first shielding engaging case. A second hook is disposed on the second shielding engaging case. A first hooking portion and a second hooking portion are disposed on the upper surface and the lower surface of the middle insulating body, respectively. The first shielding engaging case is engaged with the upper surface of the middle insulating body, wherein the first hook is interlocked with the corresponding second hooking portion on the middle insulating body. The second shielding engaging case is engaged with the lower surface of the middle insulating body, wherein the second hook is interlocked with the corresponding first hooking portion on the middle insulating body.

As a further improvement to the aforementioned technical solution, the upper terminal group and/or the lower terminal group at least includes a high frequency terminal pair, wherein the thickness of a contact portion of the high frequency terminal pair is smaller than the thickness of a portion adjacent to the contact portion.

In the present invention, the connector has a structure in which a power terminal in the upper terminal group and a corresponding power terminal in the lower terminal group are connected to form a big power terminal, and an insulating body trench for accommodating the big power terminal is disposed on the insulating body. One power terminal can carry only a limited amount of current, while a grand terminal combining two power terminals can carry much more current. Therefore, as a power terminal in the upper terminal group and a corresponding power terminal in the lower terminal group are connected together, the current capacity of the big power terminal combining two power terminals increases significantly. A large current carrying connector can thus be realized. The charging speed of a battery with high electrical capacity can thus be accelerated. Therefore, the present invention has advantages in that the fabrication process is simple and cost effective, and a large current transport is possible.

BRIEF DESCRIPTION OF THE DRAWINGS

The invention can be more fully understood by reading the following detailed description of the embodiment, with reference made to the accompanying drawings as follows.

DETAILED DESCRIPTION

In the description of the present invention, it should be noticed, orientation or position relation indicated by terms such as "at the center of," "on," "below," "in front of," "behind," "at the left of," "at the right of" are orientation or position relation in connection with the figures. These terms are used to simplify the description of the present invention, and are not intended to indicate or suggest a specific configuration or orientation in operation for the device or element being described. Therefore, these terms cannot be construed as limitations to the present invention. In addition, terms such as "first" and "second" are used for descriptive purpose and shall not be construed as indicating or suggesting an element is more significant than another.

In the description of the present invention, it should be noticed, unless otherwise specified, terms such as "mounted," "joined," and "connected" should be construed in their broad sense. For example, "connected" includes "fixedly connected," "detachably connected," or "integrally connected"; it also includes "mechanically connected" or "electrically connected"; it further includes "directly connected," "connected via an intermediate element," or implies the inner connection of two elements. The meaning of each of these terms in the present invention shall be construed by the persons having ordinary skills in the art based on the specific context. In addition, unless otherwise specified, in the description of the present invention, "a plurality of," or "several" means two or more than two.

Figure 1:
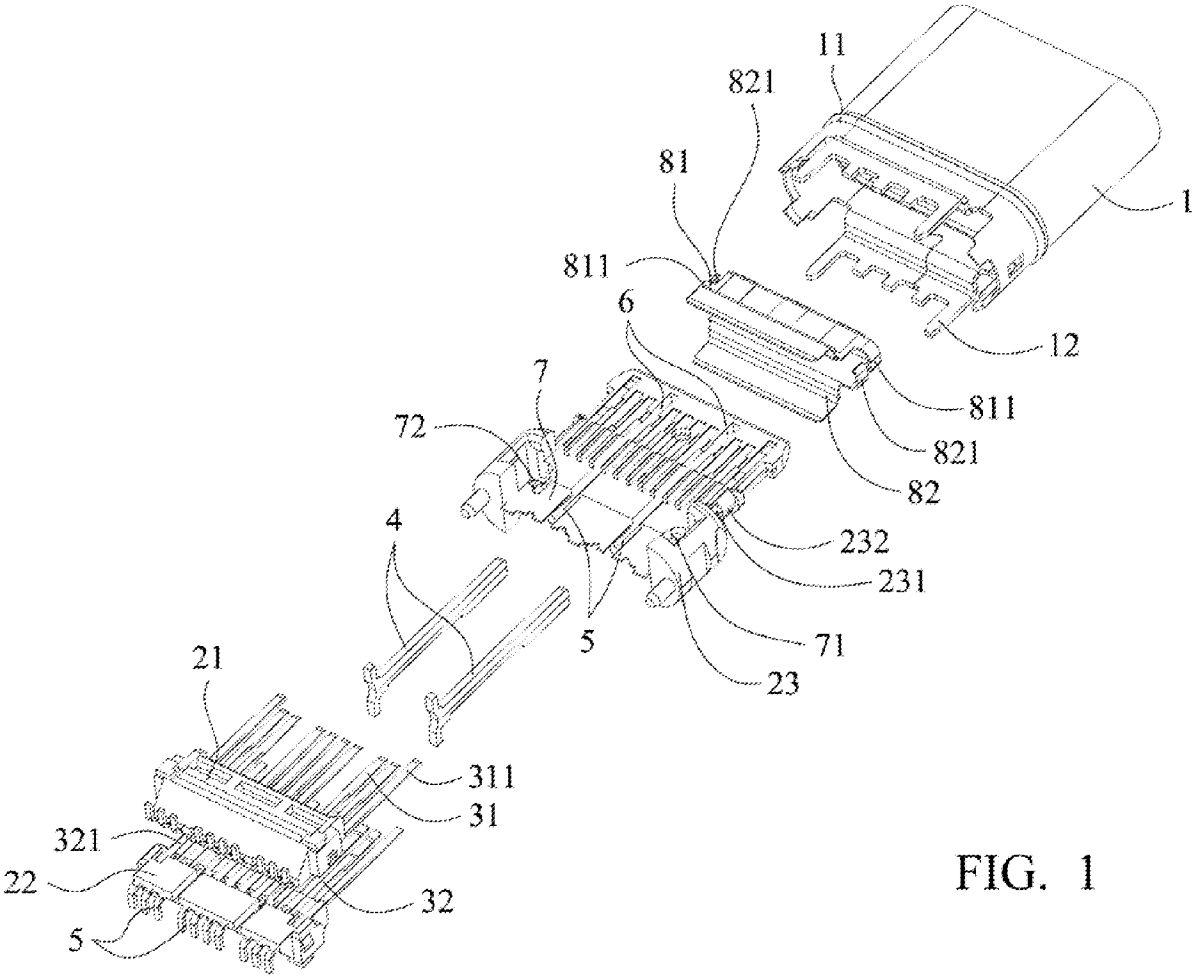
FIG. 1 is a schematic exploded view of an embodiment.
Figure 2:
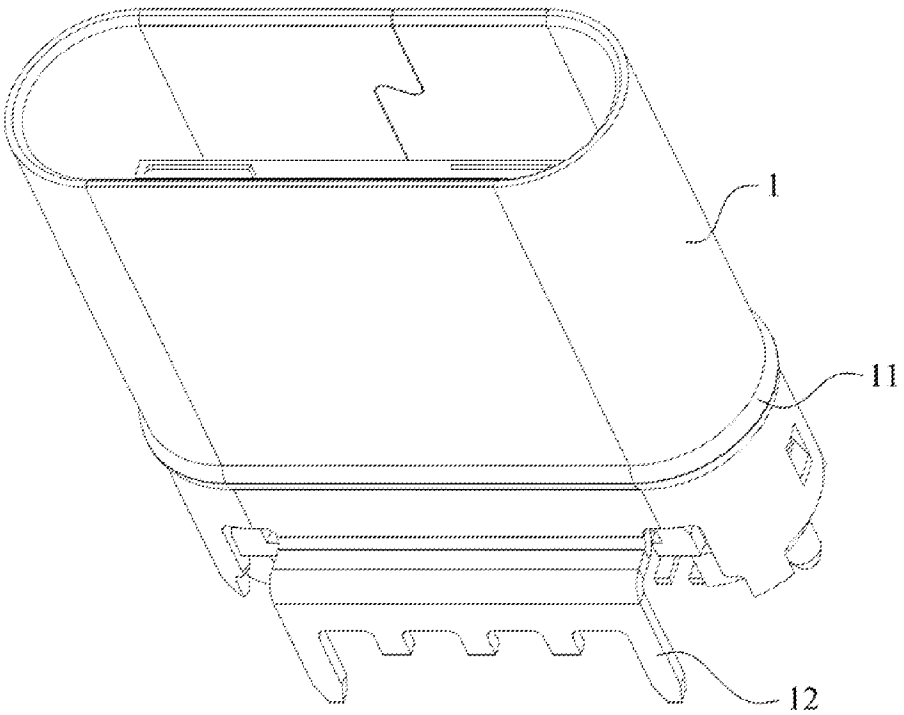
FIG. 2 is a schematic diagram of a structure built up by the components of FIG. 1.
Figure 3:
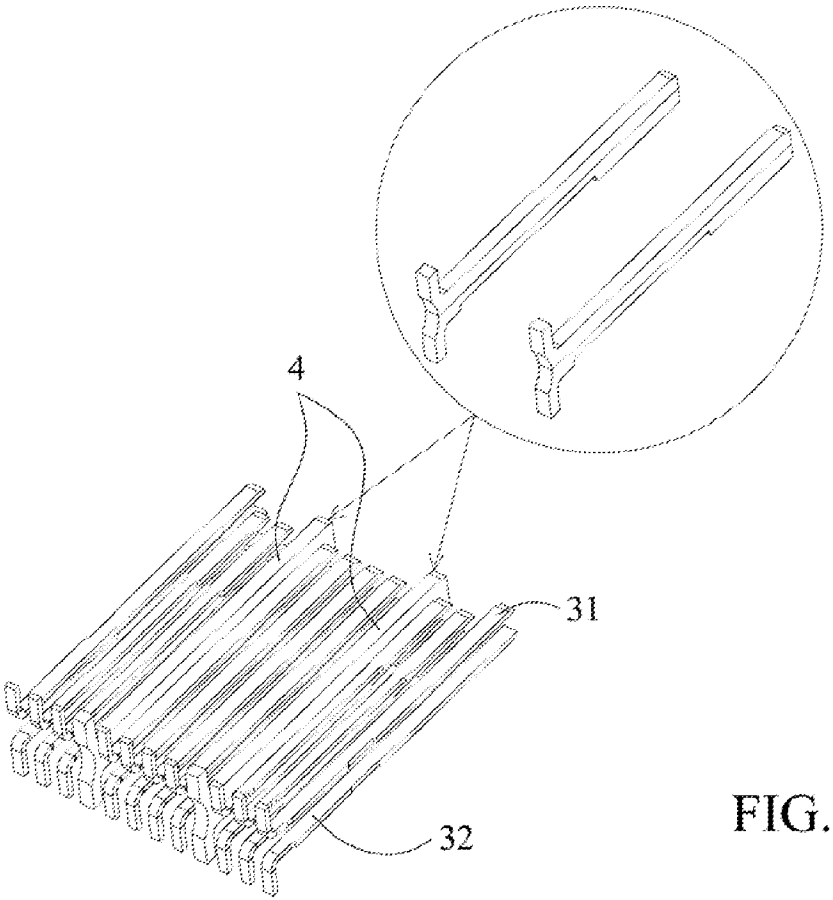
FIG. 3 is a schematic structure diagram of the big power terminal of FIG. 1.

FIG. 1 to FIG. 6 disclose a first embodiment of a large current female connector for high-speed transmission. Referring to FIG. 1 to FIG. 3 first, the insulating body includes an upper insulating body 21, a middle insulating body 23, a lower insulating body 22, an upper terminal group 31 disposed on the upper insulating body 21, and a lower terminal group 32 disposed on the lower insulating body 22. The corresponding two power terminals in the upper terminal group 31 and the lower terminal group 32 are connected to form a big power terminal 4. Insulating body trenches 5 are disposed respectively on the upper insulating body 21, the middle insulating body 23, and the lower insulating body 22. When the upper terminal group 31 is disposed on the upper insulating body 21 and the lower terminal group 32 is disposed on the lower insulating body 22, the big power terminals 4 are disposed correspondingly in the insulating body trench 5 on the upper insulating body 21 and in the insulating body trench 5 on the lower insulating body 22. When the upper insulating body 21 and the lower insulating body 22 are engaged with the middle insulating body 23, the big power terminal 4 should be correspondingly disposed in the insulating body trench 5 formed from the middle insulating body 23. Then the upper insulating body 21, the middle insulating body 23, and the lower insulating body 22 are engaged tightly to form an integrated device. Then the integrated device is mounted in the case 1. A rib 11 is disposed on the case 1. The rib 11 makes the case 1 more robust, preventing the dovetail connection from being popped out. The case 1 further includes a welding foot 12 so as to mount the connector on a PCB. Therefore, as the corresponding two power terminals in the upper terminal group 31 and the lower terminal group 32 are connected together, the current capacity of the big power terminal 4 combining two power terminals increases significantly. A large current carrying connector can thus be realized. The charging speed of a battery with high electrical capacity can thus be accelerated.

Figure 4:
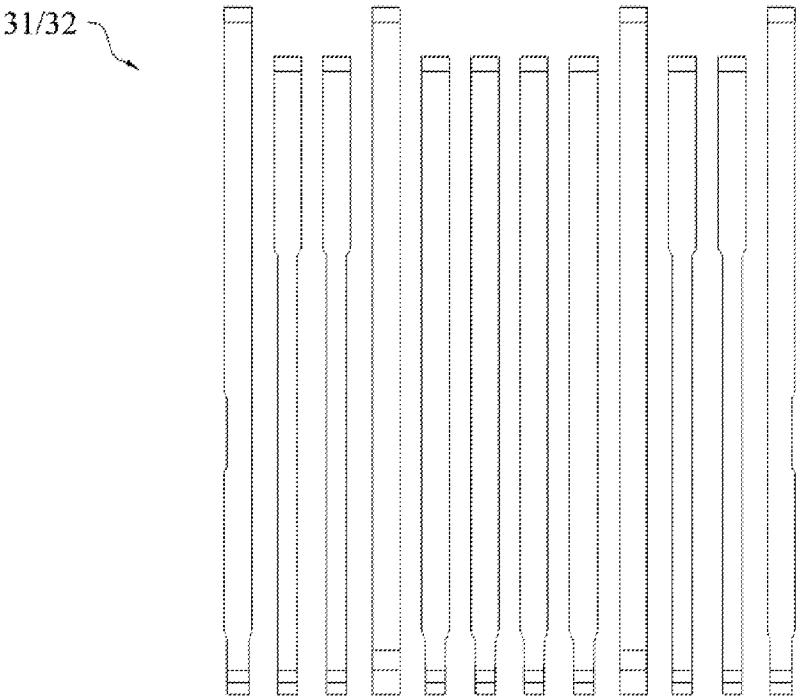
FIG. 4 is a schematic structure diagram of the upper terminal group lower terminal group of FIG. 1.
Figure 5:
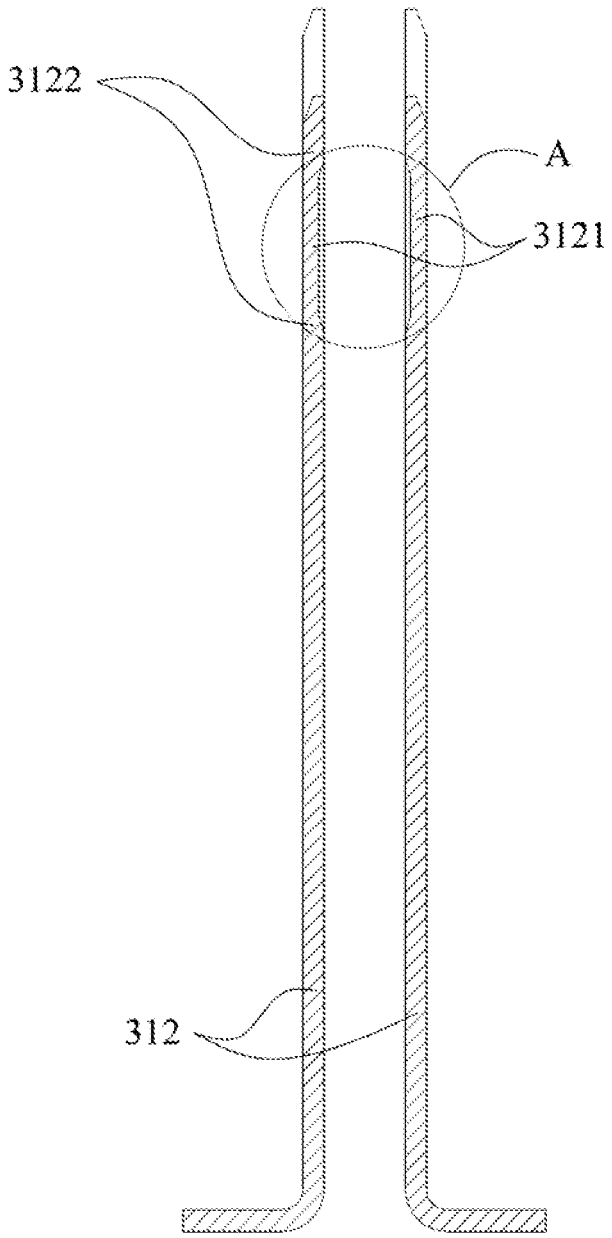
FIG. 5 is a schematic structure diagram of the high frequency terminal pairs of FIG. 4.
Figure 6:
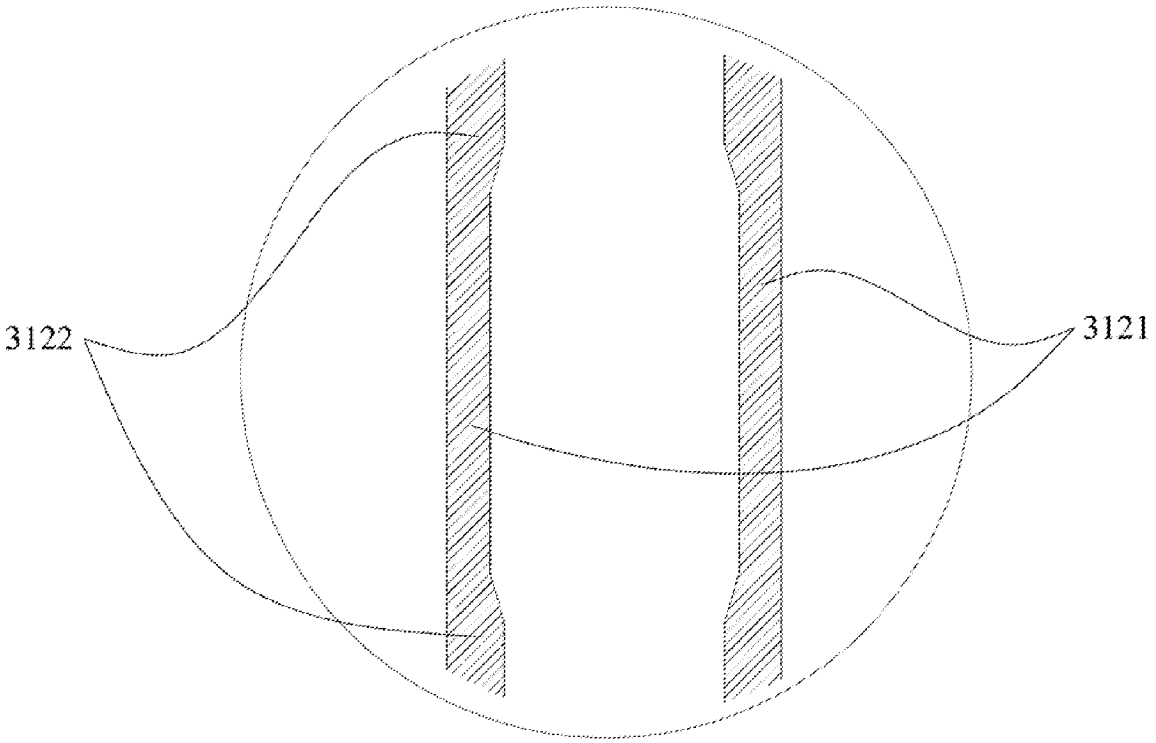
FIG. 6 is an enlarged schematic diagram of the portion A of FIG. 5.

To achieve the high frequency transmission of the terminal group, the upper terminal group 31 and/or the lower terminal group 32 at least includes a high frequency terminal pair 312. The thickness of the contact portion 3121 of the high frequency terminal pair 312 is smaller than the thickness of the portion 3122 adjacent to the contact portion 3121 (as shown in FIG. 4 to FIG. 6).

To reduce the signal interference between the upper and lower terminal groups, a shielding sheet 7 is further included. A shielding sheet trench 6 for accommodating the big power terminal 4 is disposed on the shielding sheet 7. The shielding sheet 7 is disposed in the middle insulating body 23. When the upper insulating body 21 and the lower insulating body 22 are engaged with the middle insulating body 23, the big power terminal 4 is correspondingly disposed in the insulating body trenches 5 and simultaneously disposed in the corresponding shielding sheet trench 6.

To improve the shielding effect of the shielding sheet, the shielding sheet 7 includes an upper spring plate 71 and a lower spring plate 72. The upper spring plate 71 is physically and electrically connected to the upper ground terminal 311 disposed on the upper insulating body 21. The lower spring plate 72 is physically and electrically connected to the lower ground terminal 321 disposed on the lower insulating body 22.

To improve the engagement between the upper insulating body 21 and the lower insulating body 22, a first shielding engaging case 81 and a second shielding engaging case 82 are further included. A first hook 811 is disposed on the first shielding engaging case 81. A second hook 821 is disposed on the second shielding engaging case 82. Meanwhile, a first hooking portion 231 and a second hooking portion 232 are disposed on the upper surface and the lower surface of the middle insulating body 23, respectively. The first shielding engaging case 81 is engaged with the upper surface of the middle insulating body 23, wherein the first hook 811 is interlocked with the corresponding second hooking portion 232 on the middle insulating body. Then, the second shielding engaging case 82 is engaged with the lower surface of the middle insulating body 23, wherein the second hook 821 is interlocked with the corresponding first hooking portion 231 on the middle insulating body 23.

The present invention can be implemented as a second embodiment (not shown in the figures). The second embodiment is essentially the same as the first embodiment, except that the insulating body includes an upper insulating body and a lower insulating body, in which the upper terminal group is disposed on the upper insulating body, and the lower terminal group is disposed on the lower insulating body. Insulating body trenches are disposed respectively on the upper insulating body and the lower insulating body. When the upper terminal group is disposed on the upper insulating body and the lower terminal group is disposed on the lower insulating body, the big power terminal is disposed correspondingly in the insulating body trench on the upper insulating body and in the insulating body trench on the lower insulating body. The upper insulating body and the lower insulating body are engaged with each other to form an integrated device.

To reduce the signal interference between the upper and lower terminal groups, a shielding sheet is further included. A shielding sheet trench for accommodating the big power terminal is disposed on the shielding sheet. The shielding sheet is disposed between the upper insulating body and the lower insulating body. When the upper terminal group is disposed on the upper insulating body and the lower terminal group is disposed on the lower insulating body, the big power terminal is correspondingly disposed in the insulating body trenches and simultaneously disposed in the corresponding shielding sheet trench.

The present invention can be implemented as a third embodiment (not shown in the figures). The third embodiment is essentially the same as the first embodiment, except that the insulating body is integrally formed. The upper terminal group and the lower terminal group are disposed on the insulating body. An insulating body trench for accommodating the big power terminal is disposed on the insulating body. When the upper terminal group and the lower terminal group are disposed in the insulating body, the big power terminal is disposed correspondingly in the insulating body trench. The insulating body is then disposed into the case.

To reduce the signal interference between the terminal groups, a shielding sheet is further included. The shielding sheet is inserted in the insulating body in advance. A shielding sheet trench for accommodating the big power terminal is disposed on the shielding sheet. When the upper terminal group and the lower terminal group are disposed in the insulating body, the big power terminal is correspondingly disposed in the insulating body trench and simultaneously disposed in the corresponding shielding sheet trench.

To improve the shielding effect of the shielding sheet, the shielding sheet includes an upper spring plate and a lower spring plate. The upper spring plate is physically and electrically connected to the upper ground terminal located at an upper layer of the insulating body, and the lower spring plate is physically and electrically connected to the lower ground terminal located at a lower layer of the insulating body.

What is claimed is:

1. A large current female connector for high-speed transmission, the large current female connector comprising:

a case;

an insulating body disposed in the case;

an upper terminal group and a lower terminal group disposed in the insulating body, wherein a power terminal in the upper terminal group and a corresponding power terminal in the lower terminal group are connected to form a big power terminal, and an insulating body trench for accommodating the big power terminal is disposed on the insulating body;

wherein the insulating body comprises an upper insulating body and a lower insulating body, wherein the upper terminal group is disposed on the upper insulating body; and the lower terminal group is disposed on the lower insulating body.

2. The female connector of claim 1, wherein the insulating body further comprises a middle insulating body, wherein the upper insulating body and the lower insulating body are engaged with the middle insulating body to form an integrated device.

3. The female connector of claim 2, further comprising a shielding sheet disposed in the middle insulating body, wherein a shielding sheet trench for accommodating the big power terminal is disposed on the shielding sheet.

4. The female connector of claim 1, further comprising a shielding sheet disposed between the upper insulating body and the lower insulating body, wherein a shielding sheet trench for accommodating the big power terminal is disposed on the shielding sheet and the upper insulating body and the lower insulating body are engaged with each other to form an integrated device.

5. The female connector of claim 1, further comprising a shielding sheet inserted into the insulating body, wherein a shielding sheet trench for accommodating the big power terminal is disposed on the shielding sheet, and the insulating body is integrally formed.

6. The female connector of claim 5, wherein the shielding sheet further comprises an upper spring plate and a lower spring plate, wherein the upper spring plate is physically and electrically connected to the upper ground terminal located at an upper layer of the insulating body; and the lower spring plate is physically and electrically connected to the lower ground terminal located at a lower layer of the insulating body.

7. The female connector of claim 3, wherein the shielding sheet further comprises an upper spring plate and a lower spring plate, wherein the upper spring plate is physically and electrically connected to the upper ground terminal on the upper insulating; and the lower spring plate is physically and electrically connected to the lower ground terminal on the lower insulating body.

8. The female connector of claim 4, wherein the shielding sheet further comprises an upper spring plate and a lower spring plate, wherein the upper spring plate is physically and electrically connected to the upper ground terminal on the upper insulating; and the lower spring plate is physically and electrically connected to the lower ground terminal on the lower insulating body.

9. The female connector of claim 2, further comprising:

a first shielding engaging case;

a second shielding engaging case;

a first hook disposed on the first shielding engaging case;

a second hook disposed on the second shielding engaging case;

a first hooking portion disposed on an upper surface of the middle insulating body; and a second hooking portion disposed on a lower surface of the middle insulating body, wherein the first shielding engaging case is engaged with the upper surface of the middle insulating body, while the first hook is interlocked with the corresponding second hooking portion on the middle insulating body; and the second shielding engaging case is engaged with the lower surface of the middle insulating body, while the second hook is interlocked with the corresponding first hooking portion on the middle insulating body.

10. The female connector of claim 3, further comprising:

a first shielding engaging case;

a second shielding engaging case;

a first hook disposed on the first shielding engaging case;

a second hook disposed on the second shielding engaging case;

a first hooking portion disposed on an upper surface of the middle insulating body; and a second hooking portion disposed on a lower surface of the middle insulating body, wherein the first shielding engaging case is engaged with the upper surface of the middle insulating body, while the first hook is interlocked with the corresponding second hooking portion on the middle insulating body; and the second shielding engaging case is engaged with the lower surface of the middle insulating body, while the second hook is interlocked with the corresponding first hooking portion on the middle insulating body.

11. The female connector of claim 1, wherein the upper terminal group or the lower terminal group at least comprises a high frequency terminal pair, a thickness of a contact portion of the high frequency terminal pair being smaller than a thickness of a portion adjacent to the contact portion.

12. The female connector of claim 2, wherein the upper terminal group or the lower terminal group at least comprises a high frequency terminal pair, a thickness of a contact portion of the high frequency terminal pair being smaller than a thickness of a portion adjacent to the contact portion.

13. The female connector of claim 3, wherein the upper terminal group or the lower terminal group at least comprises a high frequency terminal pair, a thickness of a contact portion of the high frequency terminal pair being smaller than a thickness of a portion adjacent to the contact portion.

14. The female connector of claim 4, wherein the upper terminal group or the lower terminal group at least comprises a high frequency terminal pair, a thickness of a contact portion of the high frequency terminal pair being smaller than a thickness of a portion adjacent to the contact portion.

15. The female connector of claim 5, wherein the upper terminal group or the lower terminal group at least comprises a high frequency terminal pair, a thickness of a contact portion of the high frequency terminal pair being smaller than a thickness of a portion adjacent to the contact portion.

16. The female connector of claim 6, wherein the upper terminal group or the lower terminal group at least comprises a high frequency terminal pair, a thickness of a contact portion of the high frequency terminal pair being smaller than a thickness of a portion adjacent to the contact portion.

* * * * *